US010173701B2

(12) United States Patent
Fan et al.

(10) Patent No.: US 10,173,701 B2
(45) Date of Patent: Jan. 8, 2019

(54) METHOD AND SYSTEM FOR LED BASED INCANDESCENT REPLACEMENT MODULE FOR RAILWAY SIGNAL

(71) Applicant: GE Lighting Solutions, LLC, East Cleveland, OH (US)

(72) Inventors: Yu Felix Fan, Montreal (CA); Luigi Tavernese, Montreal (CA); Lucas Urtiga, Laval (CA); Eden Dubuc, Lachine (CA)

(73) Assignee: GE Lighting Solutions, LLC, East Cleveland, OH (US)

( * ) Notice: Subject to any disclaimer, the term of this patent is extended or adjusted under 35 U.S.C. 154(b) by 315 days.

(21) Appl. No.: 14/964,873

(22) Filed: Dec. 10, 2015

(65) Prior Publication Data

US 2016/0348877 A1 Dec. 1, 2016

Related U.S. Application Data

(60) Provisional application No. 62/167,238, filed on May 27, 2015.

(51) Int. Cl.

| | |
|---|---|
| ***B61L 5/18*** | (2006.01) |
| ***F21K 9/23*** | (2016.01) |
| *F21V 9/08* | (2018.01) |
| *F21Y 105/16* | (2016.01) |
| *F21Y 115/10* | (2016.01) |

(52) U.S. Cl.

CPC ..... *B61L 5/18* (2013.01); *B61L 5/1845* (2013.01); *F21K 9/23* (2016.08); *B61L 2207/02* (2013.01); *F21V 9/08* (2013.01); *F21Y 2105/16* (2016.08); *F21Y 2115/10* (2016.08)

(58) Field of Classification Search

CPC ..... B61L 5/18; B61L 5/1845; B61L 2207/02; F21K 9/23; F21Y 2105/16; F21Y 2115/10; F21V 9/08

See application file for complete search history.

(56) References Cited

U.S. PATENT DOCUMENTS

| | | | |
|---|---|---|---|
| 5,664,744 | A | 9/1997 | Chew et al. |
| 6,435,459 | B1 | 8/2002 | Sanderson et al. |

(Continued)

FOREIGN PATENT DOCUMENTS

| | | | |
|---|---|---|---|
| BE | 570116 | A | 2/1959 |
| WO | 2011152879 | A1 | 12/2011 |

(Continued)

OTHER PUBLICATIONS

U.S. Non-Final Office Action issued in connection with related U.S. Appl. No. 14/490,603 dated Mar. 4, 2016.

(Continued)

*Primary Examiner* — Stephen F Husar

(74) *Attorney, Agent, or Firm* — Peter T. DiMauro; GE Global Patent Operation

(57) ABSTRACT

An apparatus including a housing; a solid state light source disposed in the housing to emit light therefrom; and a filter disposed in or on the housing in optical communication with the solid state light source to reshape a radiometric spectrum of the light emitted by the solid state light source to substantially replicate a radiometric spectrum of an incandescent filament light source.

19 Claims, 11 Drawing Sheets

(56) References Cited

U.S. PATENT DOCUMENTS

| | | | | |
|---|---|---|---|---|
| 7,490,954 | B2 * | 2/2009 | Mayer | F21S 8/00 362/235 |
| 7,766,518 | B2 | 8/2010 | Piepgras et al. | |
| 7,883,226 | B2 | 2/2011 | Li | |
| 8,684,559 | B2 * | 4/2014 | Van De Ven | F21V 5/002 257/98 |
| 2004/0066142 | A1 | 4/2004 | Stimac et al. | |

FOREIGN PATENT DOCUMENTS

| | | | |
|---|---|---|---|
| WO | 2014075737 | A1 | 5/2014 |
| WO | 2015035425 | A1 | 3/2015 |

OTHER PUBLICATIONS

PCT Search Report and Written Opinion issued in connection with corresponding Application No. PCT/US2014/056400 dated Jan. 15, 2015.

International Search Report and Written Opinion issued in connection with corresponding Application No. PCT/US2016/029645 dated Jul. 27, 2016.

* cited by examiner

METHOD AND SYSTEM FOR LED BASED INCANDESCENT REPLACEMENT MODULE FOR RAILWAY SIGNAL

This non-provisional application claims the benefit of priority under 35 U.S.C. § 119(e) to U.S. Provisional Patent Application No. 62/167,238, entitled "METHOD AND SYSTEM FOR LED BASED INCANDESCENT REPLACEMENT MODULE FOR RAILWAY SIGNAL", filed May 27, 2015, which is herein incorporated in its entirety by reference.

BACKGROUND

The maintenance and operation of commuter rail, rapid transit, and freight railroad systems requires effective, reliable, and efficient wayside signals. Conventional railroad wayside and other signals typically employ clear, transparent, or translucent lenses or filters constructed of glass or other materials, or lenses or filters tinted in various colors. The railroad wayside and other signals (generally referred to herein as railway signals) are historically illuminated by an incandescent lamp or bulb within the railway signal's housing. Some common colors for the lenses or filters used in many railway signal housings include blue, red, green, yellow, white, magenta/violet, and cyan. Maintenance personnel and others are accustomed to the typical light output from conventional railway signals having incandescent lamps and bulbs and the signal housing lenses and filters.

Solid state light sources such as a light emitting diode (LED) are more efficient than incandescent bulbs and lamps. Therefore, it would be desirable to provide methods and systems for a LED based incandescent replacement module for railway signals.

BRIEF DESCRIPTION OF THE DRAWINGS

Features and advantages of some embodiments of the present invention, and the manner in which the same are accomplished, will become more readily apparent upon consideration of the following detailed description of the invention taken in conjunction with the accompanying drawings, wherein.

DETAILED DESCRIPTION

Figure 1:
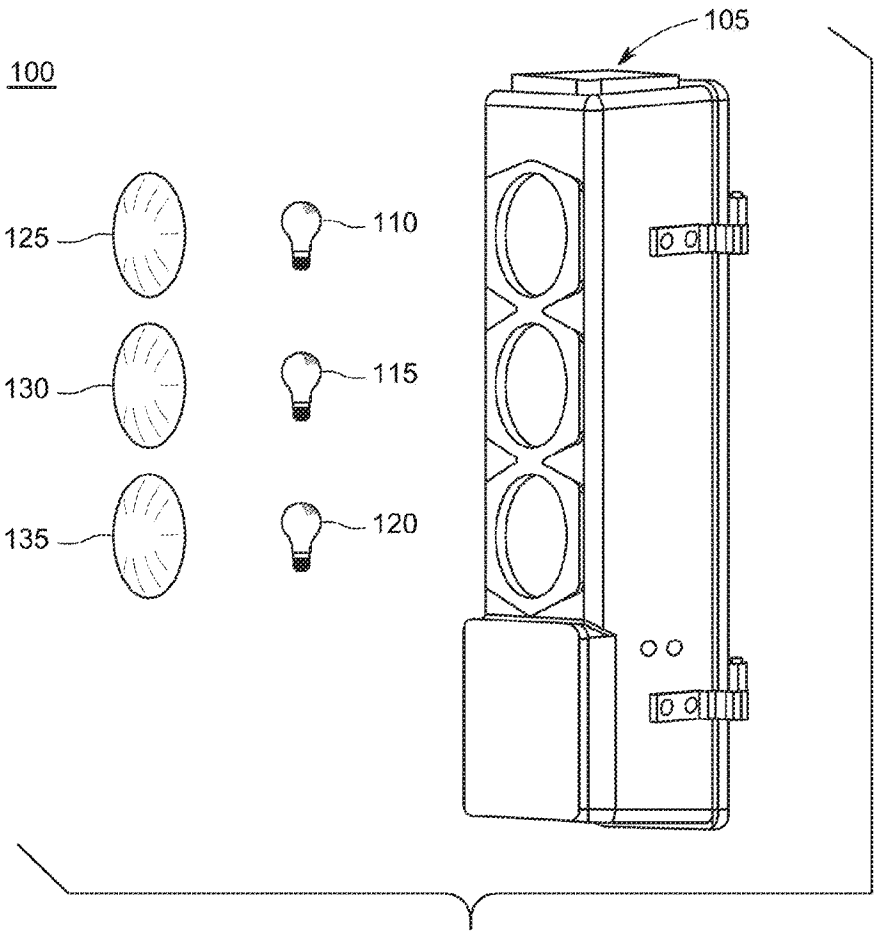
FIG. 1 PRIOR ART
FIG. 1 is an illustrative depiction of a conventional railway signal having incandescent bulbs.

FIG. 1 is an illustrative depiction of a conventional railroad wayside signal 100. Railroad wayside signal 100 includes a housing 105 within which white incandescent bulbs 110, 115, and 120 are housed. Upon being energized by a source of power (not shown), white light is emitted from incandescent bulbs 110, 115, and 120, with at least some of the emitted light being transmitted through lenses 125, 130, and 135. In some aspects, lenses 125, 130, and 135 are colored to effectuate a light transmission of a certain, particular color.

In some aspects, the brightness, color, and other characteristics of the light transmitted by a railroad wayside signals may be governed by rules, regulations, and/or laws issued by one or more of industry entities, municipal governments, regulatory agencies, or other entities. Accordingly, the brightness, color, and other characteristics of the light transmitted by a railroad wayside signal may be required to adhere to or meet certain applicable "standard" criteria.

In some aspects, solid state based wayside signal systems herein may operate to improve visibility and sighting distance under various weather conditions, and provide energy-cost savings, as compared to railway signals having incandescent bulbs. Some other LED based railroad wayside signals were previously known. However, such railroad wayside signals are typically characterized as strictly using monochromatic LEDs for each corresponding color signal of the railroad wayside signal and typically using white LEDs strictly for dedicated white signals. Accordingly, such previous LED based railroad wayside signals are logistically cumbersome and complex to manage and operate, as well as increase maintenance costs and risks since dedicated color-specific monochromatic LEDs must be used therein.

Figure 2:
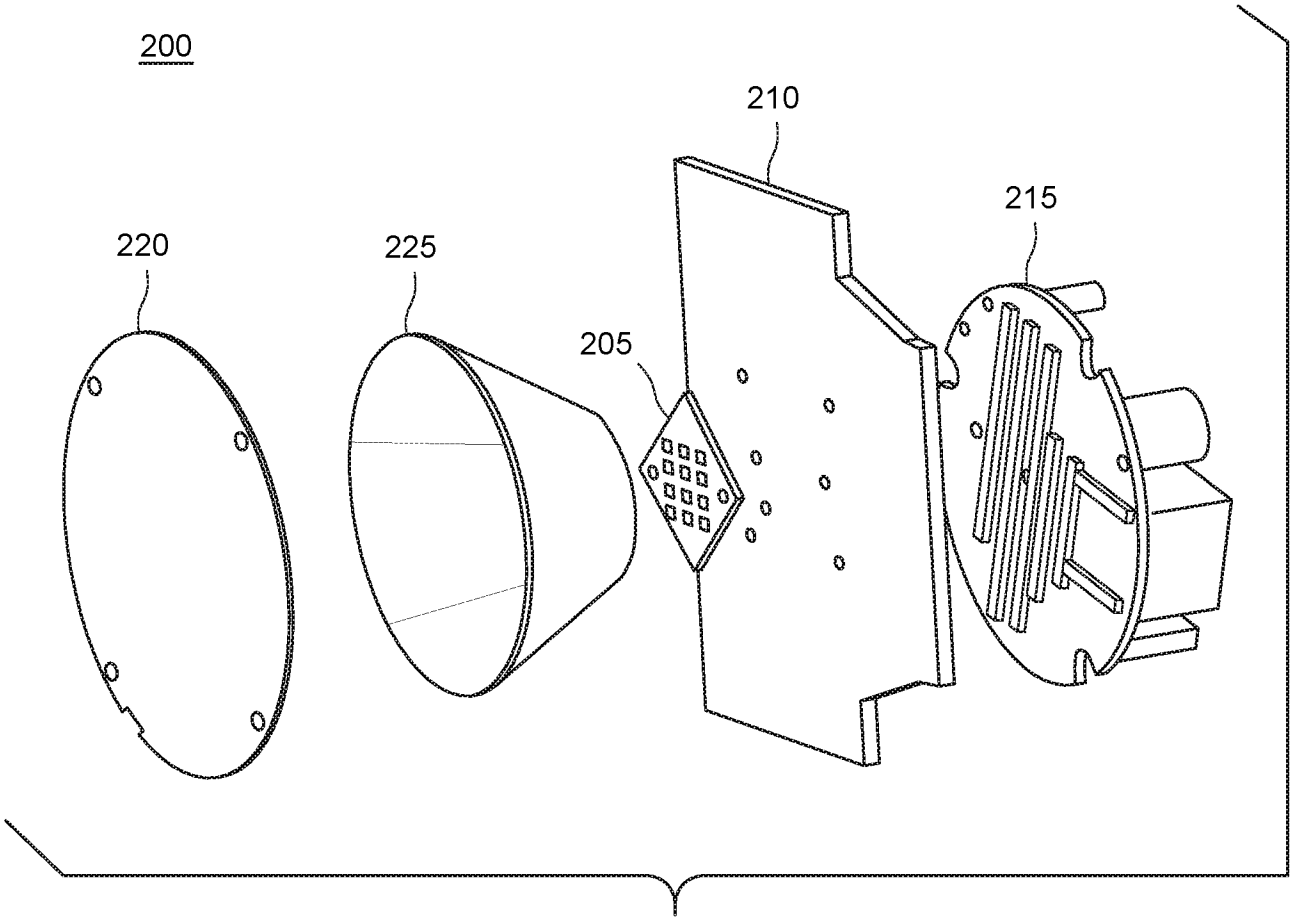
FIG. 2 is an illustrative depiction of a LED replacement module for a railway signal, according to some embodiments herein.

Applicants hereof have realized a railroad wayside signal module that uses one or more (i.e., multiple) solid state light sources such as, for example, a LED. Referring to FIG. 2, a LED based incandescent replacement module for a railway signal is illustratively generally depicted at 200. Module 200 includes a solid state light source 205. Solid state light source 205 may include one or more LEDs or chip-on-board (COB) LED arrays that appear white or substantially white. As used herein, the array of single or multiple LEDs that appear white or "substantially white", will be referred to as a "white LED device" for convenience sake. In accordance with some aspects herein, solid state light source 205 is an array of warm white or white light LEDs having a color temperature of less than about 2800 K. However, "warm white" is not always limited to such a color temperature range, and may comprise any warm white color temperature, as would be understood in the field.

In the particular embodiment shown in FIG. 2, the light source comprises an array of LEDs. The array of LEDs are assembled on a printed circuit board (PCB) that provides an electrically conductive conduit between light source 205 and a power supply unit 215. The light source 205 is shown supported by a heat sink 210. In some embodiments, power supply 215 may interface with electrical and/or components of existing railway signals or legacy railway signal designs without a need to modify such railway signals.

Railway signal module 200 further includes a color filter 220. Color filter 220 is disposed adjacent to solid state light source 205 to reshape the radiometric spectrum of the light emitted from light source 205. In some embodiments, color filter 220 is designed to reshape the radiometric spectrum of the light emitted from solid state light source 205 such that the light transmitted from light source 205 and through color filter 220 effectively and efficiently replicates the spectrum of light transmitted by a conventional incandescent bulb having a color temperature of less than about 2800 K and/or a monochromatic LED product.

Railway signal module 200 is shown further including optional reflector 225 that is disposed between white LED light source 205 and color filter 220. Reflector 225 may provide a mechanism to improve an optical efficiency of module 200 by reflecting at least a portion of the light transmitted from white LED light source 205 towards and through filter 220. In some embodiments, railway signal module 200 may be retrofitted into existing railway signals or legacy railway signal designs without a need to modify such railway signals.

In some embodiments, the white LED device of module 200 may be configured as spherical, cylindrical, or conical in a front portion of the module with power supply 215 in a rear portion of the module. In some embodiments, power supply 215 may be made mechanically and/or electrically compatible with an existing railway signal housing or design so that embodiments of the replacement modules disclosed herein may be used as a direct retrofit to a railway signal housing.

It is noted that railway wayside signals have traditionally used warm white incandescent bulbs (i.e., a color temperature <2800K) in order to maintain sufficient brightness for red signals. Applicants hereof have recognized that it is important to perform any LED retrofit of an existing incandescent-illuminated railroad wayside signal housing in such a way that any change in the signaling system does not materially alter or change the expected (in some instances, required) appearance of the signal to a train driver and other relevant personnel. In an effort to effectively replicate a railroad wayside signal having an incandescent bulb in some embodiments of a LED replacement module disclosed herein, as well as to minimize the effort of designing desired color filtering, the white LED device selected in some embodiments herein may generally have characteristics that approximate the color temperature and light intensity of an incandescent counterpart railroad wayside signal.

Figure 3:
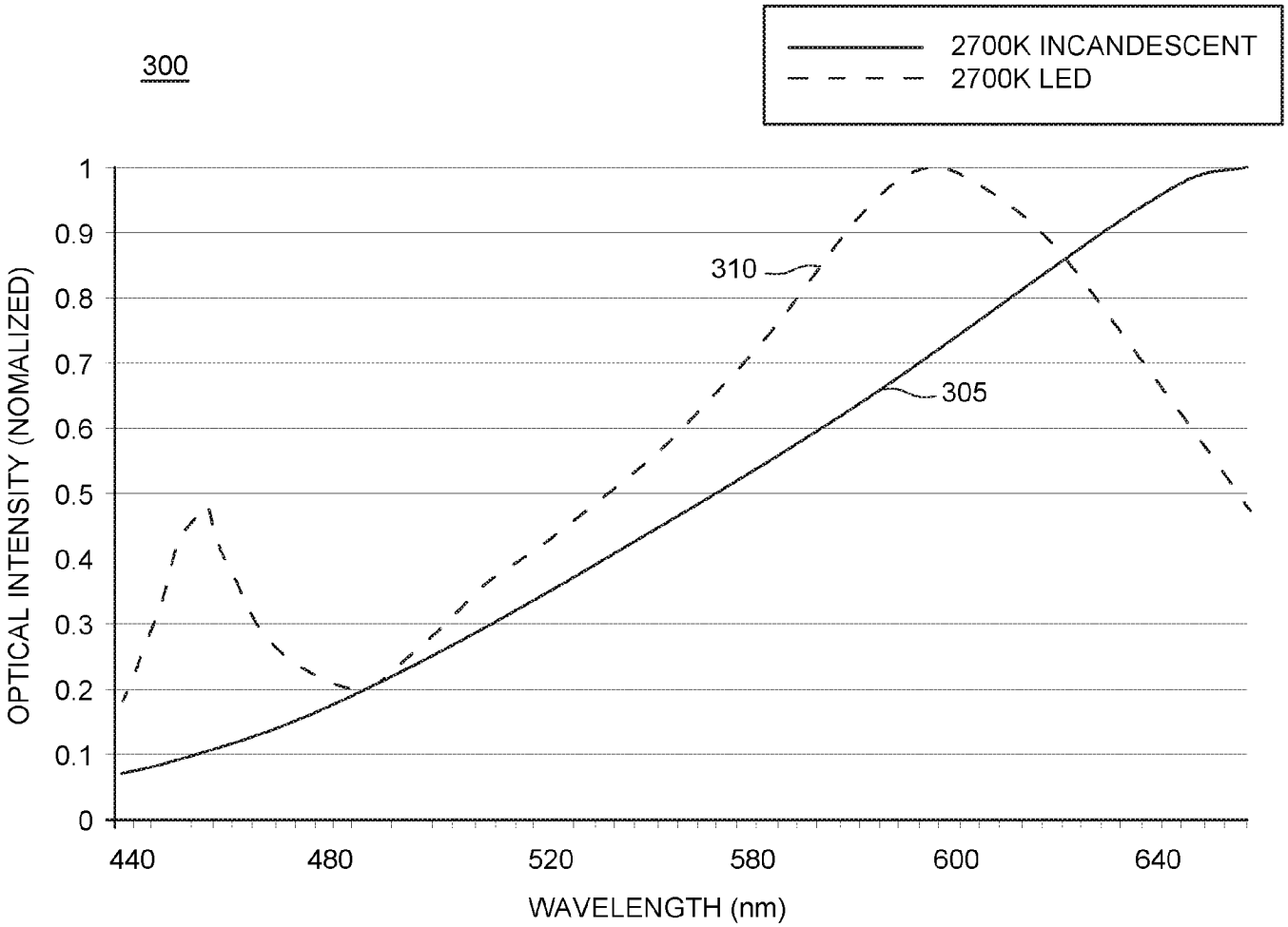
FIG. 3 is a plot of optical intensity spectrumS for an incandescent bulb and a LED, according to some embodiments herein.

It is noted that there is a difference in the respective radiometric spectra of light emitted from a warm white incandescent bulb, and a white LED device, herein with both having a color temperature of about less than 2800 K (e.g., about 2700 K), even though they may have a similar color temperature and photometric brightness. FIG. 3 is a graph 300 including an illustrative plot 305 of the optical emission intensity for a 2700 K incandescent bulb and an illustrative plot 310 of the optical emission intensity for a warm white LED (e.g., 2700 K) herein. In some aspects as illustrated in graph 300, the incandescent bulb's optical intensity spectrum exhibits an increasing monotonous optical intensity from the shorter wavelength region to the longer wavelength region. However, the white LED device features an optical intensity peak at about 450 nm due to a blue bump or hump, followed by an optical intensity valley at about 480 nm, then the optical intensity thereof may increase monotonously until reaching a global peak at about 600 nm, and thereafter the optical intensity decreases as the wavelength increases.

As illustrated in FIG. 1, the light generated from an incandescent bulb may be transmitted through colored glass lenses in a railroad wayside signal use-case. Furthermore, the light transmitted through the lenses of the railroad wayside signal may be required and/or at least desired to meet specific chromaticity requirements of an industrial standard (e.g., the American Railway Engineering and Maintenance-of-Way Association, AREMA) or other applicable standards and objectives. It is noted that in the specific instance where the optical intensity spectrum of white LED devices differs from an incandescent bulb (including bulbs of a similar color temperature), chromaticity of the resultant light transmitted from a railroad wayside signal having the white LED device as disclosed herein may vary from the required and/or at least desired chromaticity requirements of applicable industrial or other specification(s). Applicants hereof have realized that the variance between the optical intensity spectrum of white LED devices used herein and incandescent bulbs should be compensated for in order to achieve the required and/or at least desired chromaticity requirements of applicable industrial or other specification (s).

Figure 4:
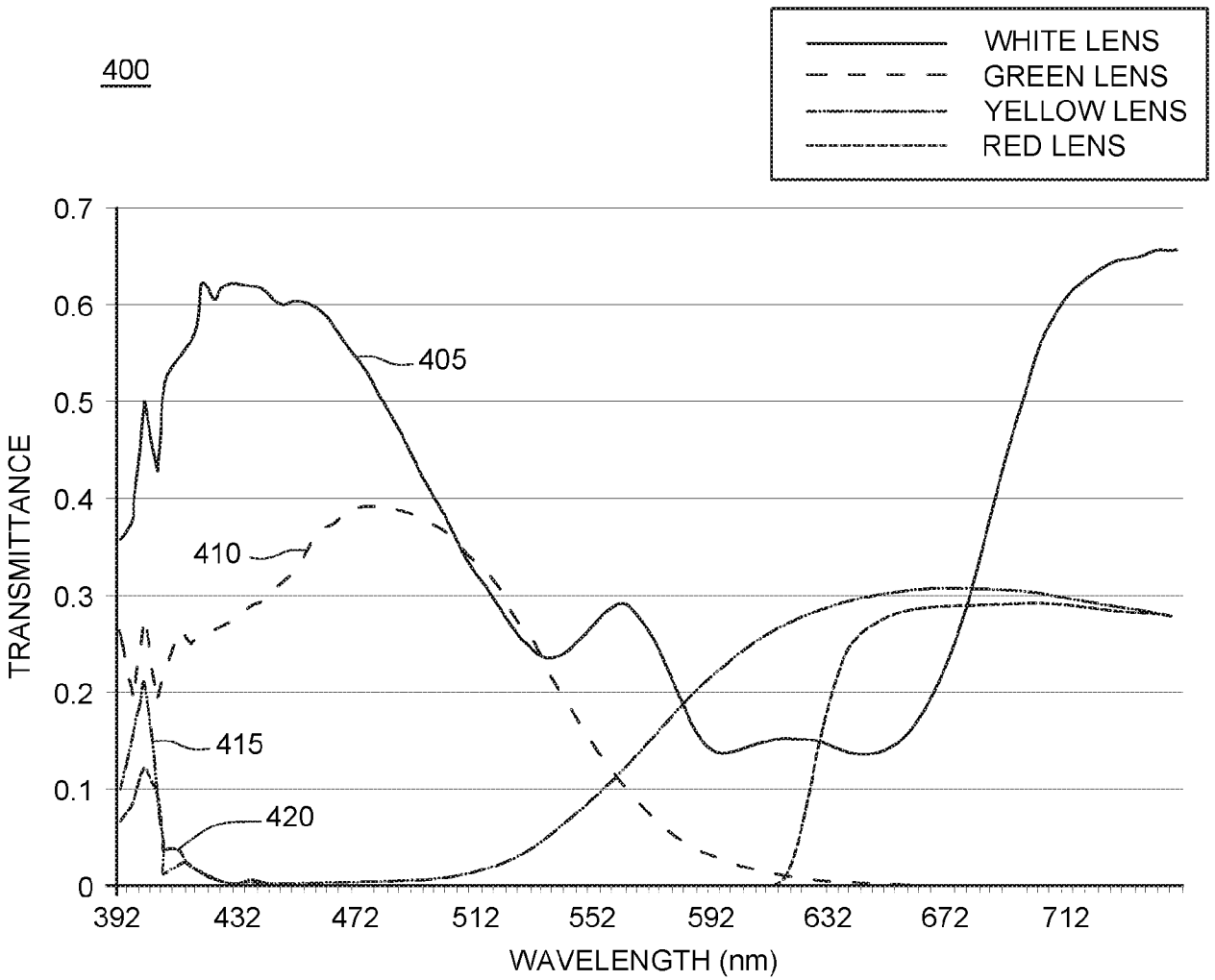
FIG. 4 is a graph including transmittance spectrum plots for some conventional railway signal color lenses having an incandescent bulb.

FIG. 4 is a graph 400 including plots of the transmittance of different colored lenses for a railroad wayside signal having colored lenses in the housing thereof, as illustrated in FIG. 1. Plot 405 reflects a white lens, plot 410 reflects a green lens, plot 415 represents a yellow lens, and plot 420 refers to the transmittance through a red lens. As illustrated, the transmittance varies dramatically depending on the colored lens. In some aspects, the railroad wayside LED replacement module disclosed herein provides a mechanism that is efficiently applicable for a range of colored lenses, including at least those lenses depicted in FIG. 4.

Figure 5:
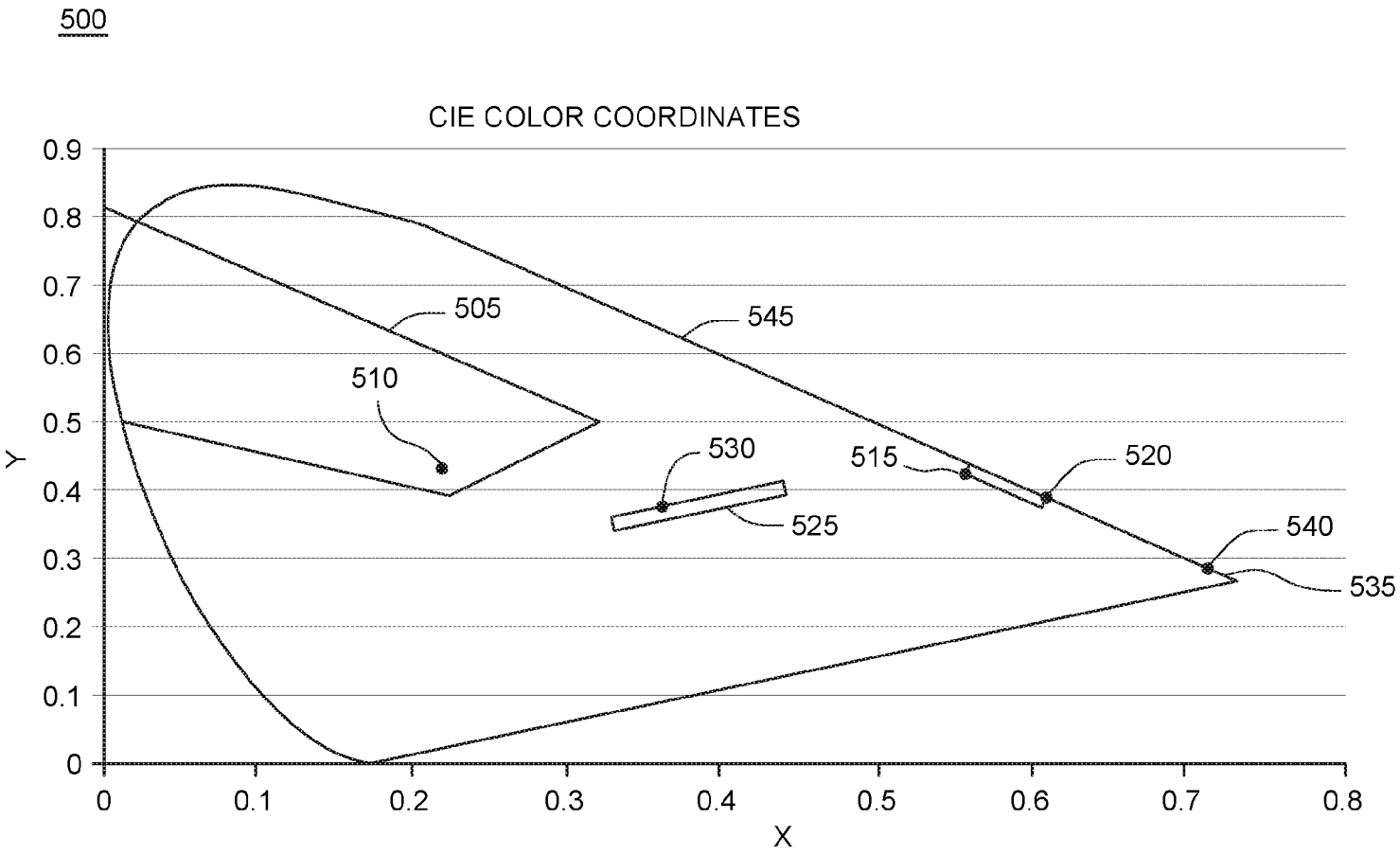
FIG. 5 is illustrative chromaticity plots for a conventional railway signal having an incandescent bulb.

FIG. 5 is a depiction of graph 500 including a representation of a railroad signal color space specification 545, as shown on a CIE coordinate system. Graph 500 includes a depiction of the color specification for AREMA green at 505, AREMA yellow at 515, AREMA white at 525, and AREMA red 535. Graph 500 further includes a depiction of the chromaticity performance for a warm white incandescent bulb (e.g., 2700K) and a green lens at 510, the incandescent bulb and a yellow lens at 520, the incandescent bulb and a white lens at 530, and the incandescent bulb and a red lens at 540. As illustrated in FIG. 5, the chromaticity performance for the combination of the incandescent bulb and each of the colored lenses is within the acceptable ranges for all of the colored lenses.

Referring again to FIG. 2, in some embodiments herein a color filtering mechanism 200 is provided to reshape the optical intensity spectrum of the white LED devices 205 included in the railroad wayside signal replacement module 200 such that the resultant or final optical intensity spectrum transmitted after filtering or reshaping by filter 220 is substantially equal to the optical intensity spectrum of incandescent light sources. In some embodiments, a transfer function of a color filtering system or device herein is:

$$\begin{cases} f_{White\ LEd\ Device}(\lambda) \cdot f_{Color\ Filtering}(\lambda) = f_{Incandescent}(\lambda) \\ 400\ \text{nm} \le \lambda \le 700\ \text{nm} \end{cases}$$

where $\lambda$ is the optical intensity spectral unit (or wavelength) in nanometers and $f$ refers to a spectral function.

Figure 6:
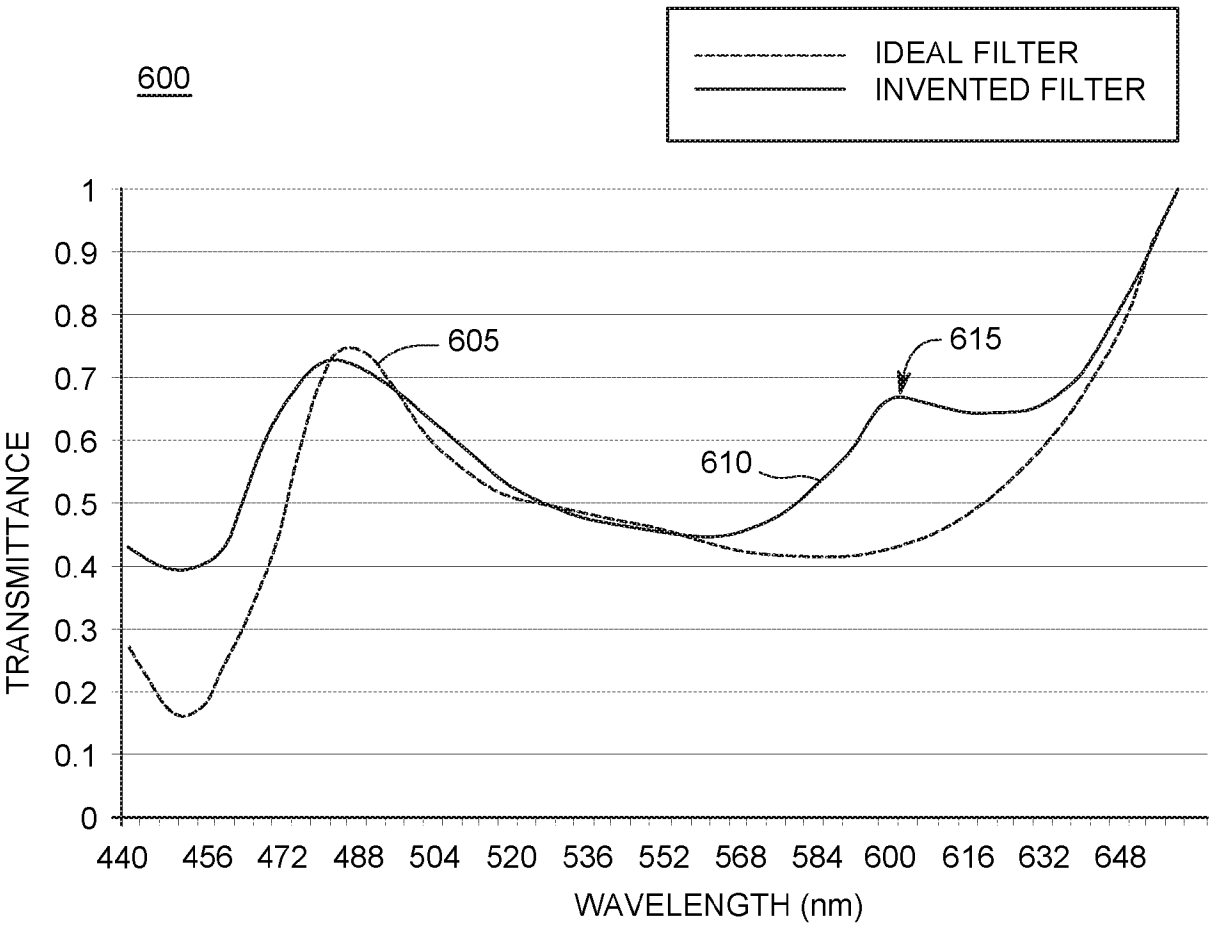
FIG. 6 is a graph including transmittance spectrum plots for filters of a railway signal LED replacement module, according to some embodiments herein.

In some embodiments, due at least in part to manufacturing limitations, it may not be possible or practicable to achieve an ideal color filter as specified by the foregoing transfer function. Applicants have thus realized practicable color filters in accordance with the present disclosure having an optical transmittance spectrum that is functionally acceptable (i.e., within desired or required specifications) and can be efficiently manufactured. FIG. 6 is a graph 600 including a plot 605 for the optical transmittance for an ideal color filter based on the transfer function above and plot 610 is a plot representing the optical transmittance for an actual color filter produced based on the transfer function above. Characteristics of actual color filtering devices and systems developed in accordance with the present disclosure may have an optical transmittance spectrum that can be described as:

(1) having a low transmittance region at about 440 nm to 460 nm, to suppress the white LED device's blue bump residue;

(2) having is a high transmittance region at about 470 nm to 490 nm, to compensate for the low brightness of white LED device in the same wavelength region;

(3) having a comparatively shallow low transmittance region between about 520 nm and 580 nm, to slow down the rapid spectral increment of the white LED device in the same wavelength region;

(4) having a high transmittance region at about 590 nm to 610 nm, to ensure the final signal module meets a specified railroad yellow signal chromaticity specification without impacting other colored signals (an exemplary high transmittance region is shown around element labelled 615 in FIG. 6); and (5) having a transmittance that increases monotonously and rapidly for wavelengths longer than about 630 nm, to ensure a strong(est) possible brightness for a red color signal.

In some embodiments, a normalized optical intensity transmission ratio amongst the five wavelength windows described above can be described as follows:

1. 0.35-0.45 at about 450 nm;
2. 0.65-0.75 at about 480 nm;
3. 0.40-0.60 between about 520 nm and about 580 nm;
4. 0.65-0.75 at about 600 nm; and
5. greater than 0.7 at about 640 nm.

Figure 7:
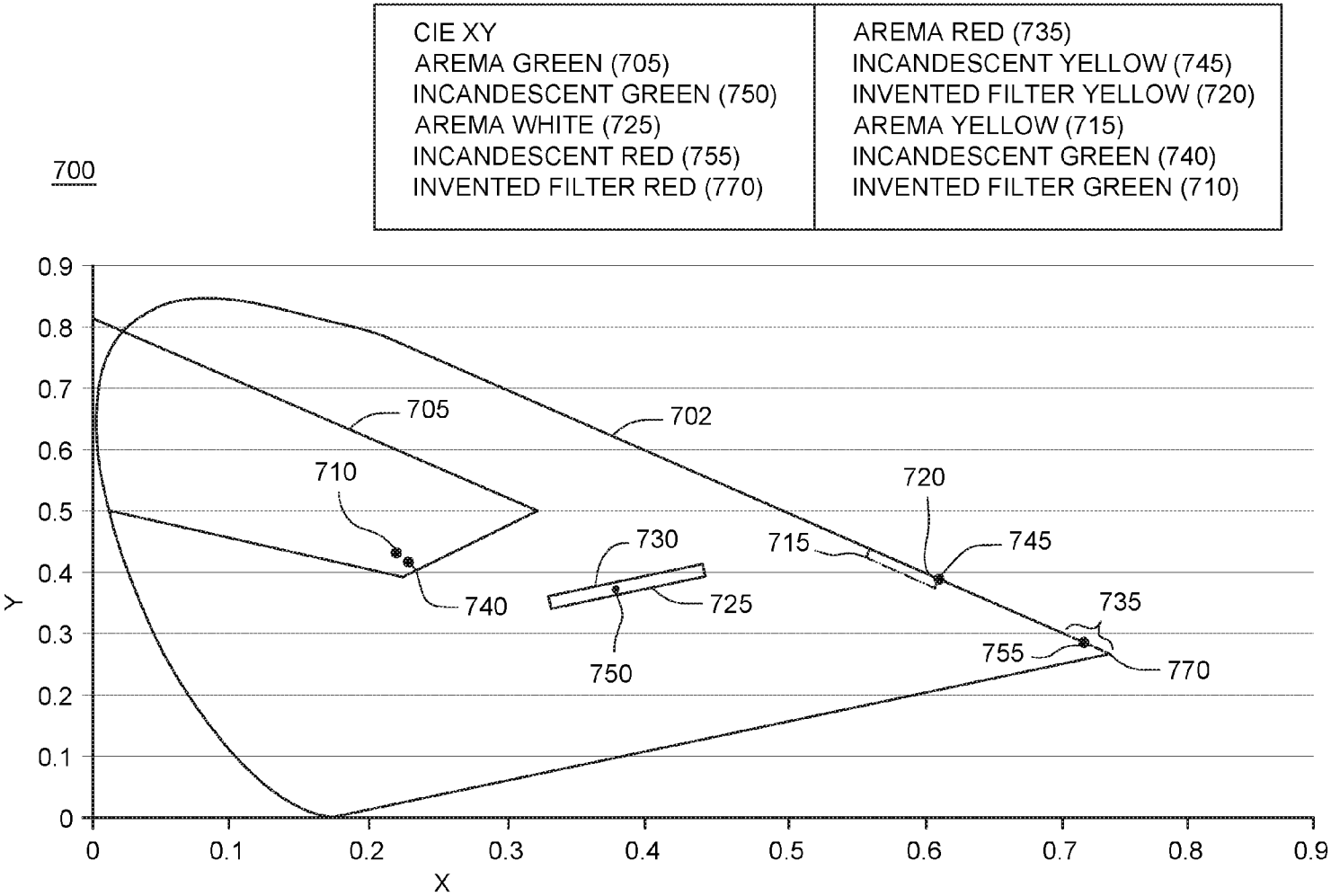
FIG. 7 is an illustrative chromaticity plot for a railway signal LED replacement module, according to some embodiments herein.

FIG. 7 is a depiction of graph 700 including a representation of a railroad signal color space specification 702, as shown on a CIE coordinate system. Graph 700 includes a depiction of the color specification for AREMA green at 705, AREMA yellow at 715, AREMA white at 725, and AREMA red 735, in a manner similar to FIG. 5. Graph 700 further includes a depiction of the chromaticity performance for a white LED (e.g., 2700K) and a green lens at 710, the white LED and a yellow lens at 720, the white LED and a white lens at 730, and the white LED and a red lens at 770. As illustrated in FIG. 7, the chromaticity performance for the combination of the white LED and each of the colored lenses is within the acceptable ranges for all of the colored lenses. The chromaticity performance for the combination of a white incandescent bulb and each of the colored lenses is also shown in FIG. 7 at plot locations 740, 745, 750, and 755 within the acceptable ranges for all of the colored lenses.

In some aspects, a desired goal of the present disclosure is to provide an efficient incandescent replacement system and methodology based on white LED devices and color filters in combination for general industrial, commercial, and residential applications. As such, in the event a railroad signal chromaticity specification or other relevant specification or desired result is revised and/or colored housing lenses are changed subsequent to the design of a particular color filter herein, the color filter(s) can be varied or redesigned to have optical characteristics that appropriately and fully compensate for change(s) in the desired and/or required resultant chromaticity specification(s).

Figure 8:
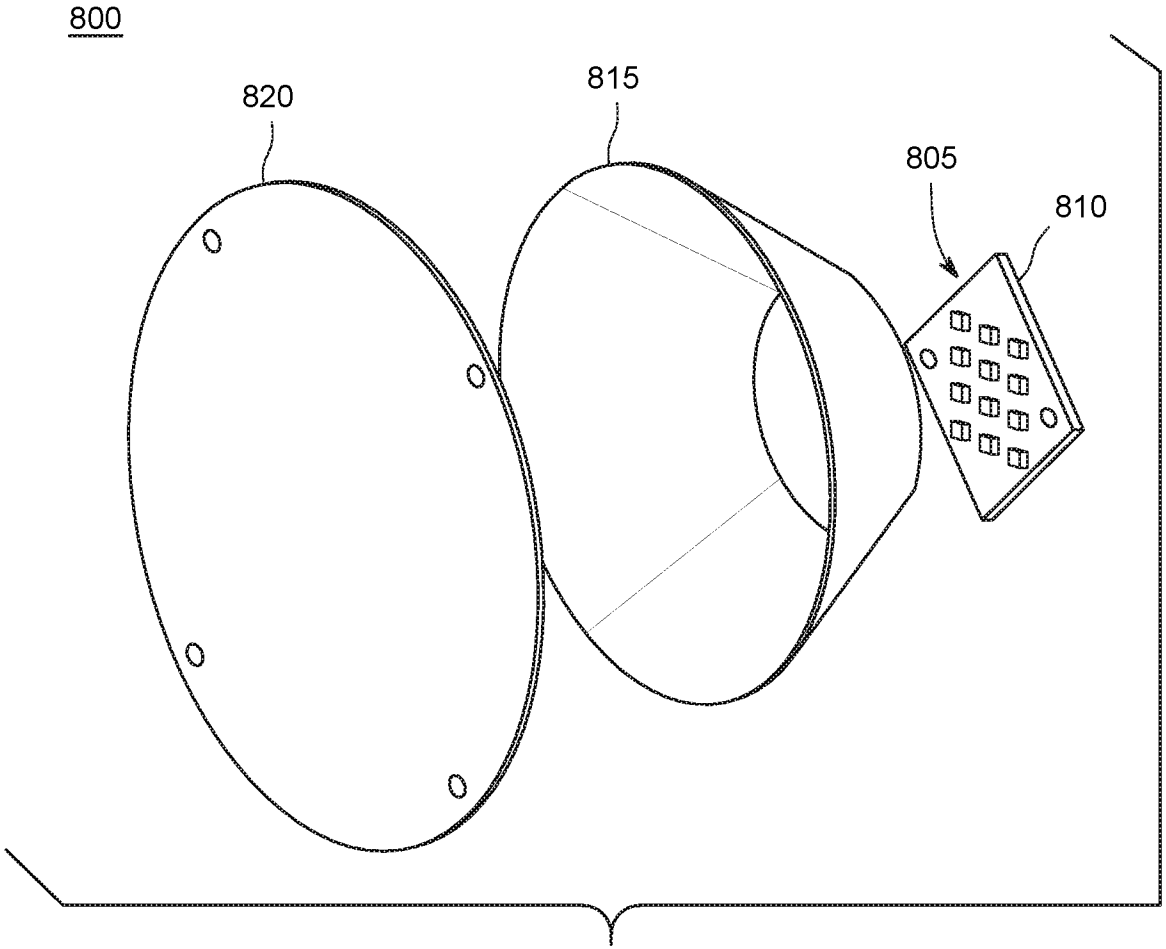
FIG. 8 is an illustrative depiction of a railway signal LED replacement module, according to some embodiments herein.

In some embodiments and for purposes of enhancing an optical efficiency of a LED based replacement module or system herein, a conical optical reflector may be included in an area surrounding the white LED device. FIG. 8 is an illustrative depiction of a LED based replacement module or system 800, in accordance with some aspects herein. System 800 includes an array 805 of white LEDs assembled on a PCB 810. Module 800 further includes a conical reflector 815 disposed between LED array 805 and color filter 820. In some aspects, conical reflector 815 may be shaped and positioned to reflect light from LED array 805 towards and through color filter 820 more efficiently than a system not having a reflector 815. In some embodiments, conical reflector 815 may be a linear or curved parabolic. In some embodiments, conical reflector 815 may have an inner reflective surface finish that can be specular, frosted, or include micro-facets to meet different optical performance and anti-reflection criteria. In an effort to improve a brightness contrast between red and other colors, and to at least enhance anti-reflection, a reflective surface of reflector 815 can be coated red and aligned with a red lens filter 820.

Figure 9:
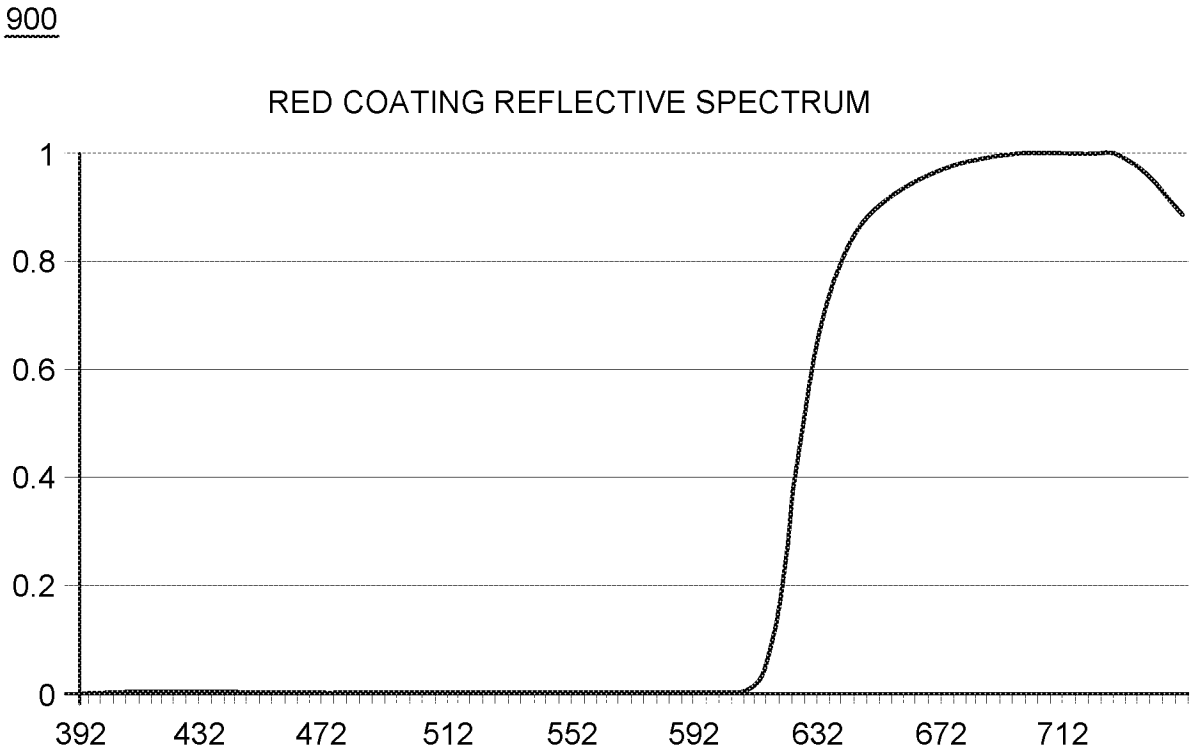
FIG. 9 is a graph including reflectance spectrum plot for LED replacement module reflector, according to some embodiments herein.

FIG. 9 is an illustrative depiction of the optical spectrum 900 for a white LED based replacement module or system herein having a conical optical reflector with a red inner reflective surface. In particular, FIG. 9 illustrates the highly reflective characteristics of such a red coated reflector used in combination with a red colored filter, in accordance with some embodiments herein.

Figure 10:
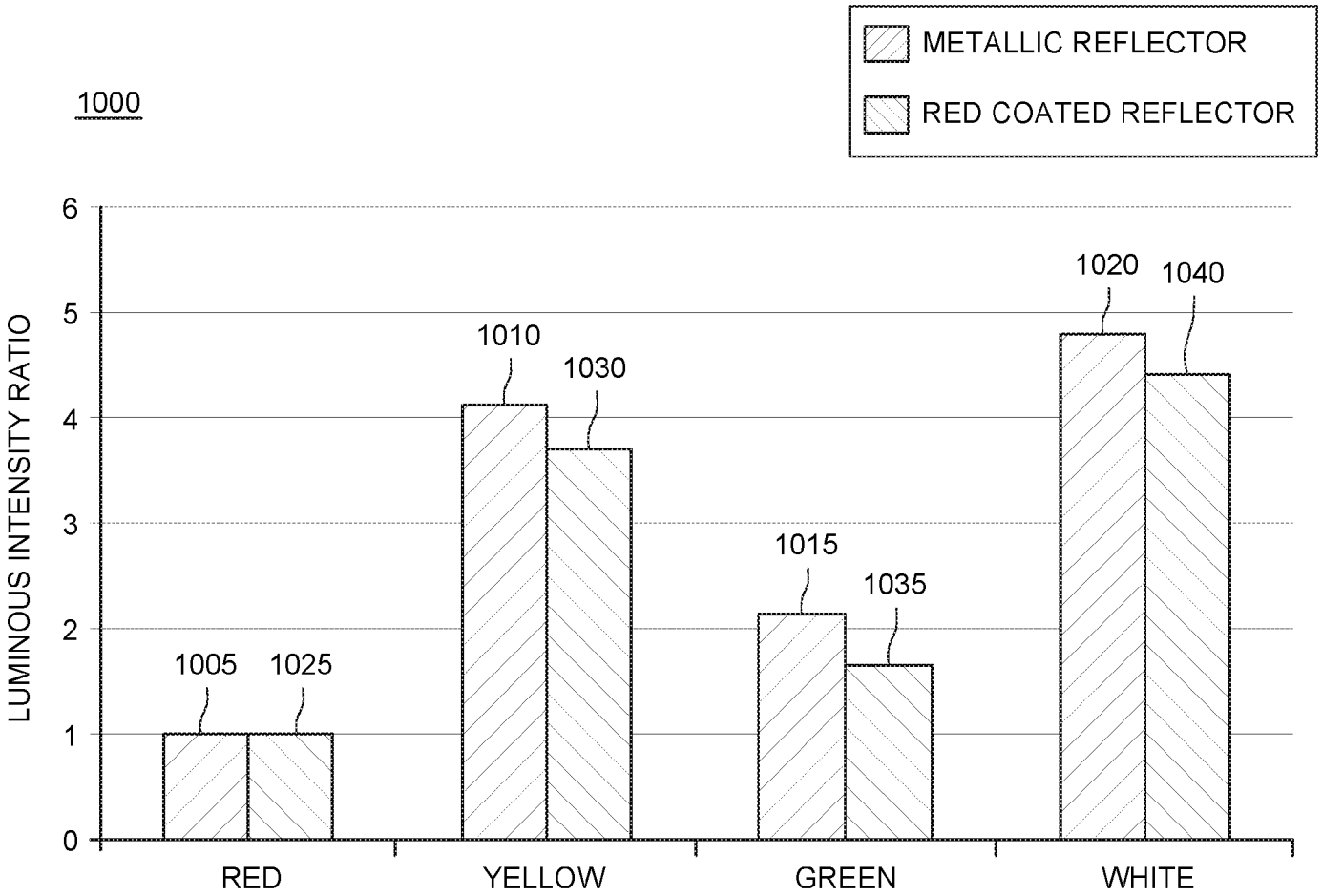
FIG. 10 is a luminous intensity ratio plot, according to some embodiments herein.

FIG. 10 is a graph illustrating relative luminous intensity ratios for a white LED based replacement module or system herein for different colored lenses of a railroad wayside signal. FIG. 10 shows luminous intensity ratios between the different colored lenses for a replacement module having conical reflector with a metallic (i.e., non-colored) inner reflective surface for a red lens at 1005, a yellow lens at 1010, a green lens at 1015, and a white lens at 1020. FIG. 10 further shows luminous intensity ratios between the different colored lenses for a replacement module having conical reflector with a red coated inner reflective surface for the red lens at 1025, the yellow lens at 1030, the green lens at 1035, and the white lens at 1040. As shown, there is relatively less disparity between the different colors for the replacement module having the conical optical reflector with the red inner reflective surface. That is, the luminous intensity is more balanced between the different colors in the replacement module with the conical optical reflector with the red inner reflective surface. Such a device, system, or module may present a more consistent or uniformly bright signal to an end-user observer of the different colors transmitted by the module having a white LED, in accordance with some embodiments herein.

Figure 11:
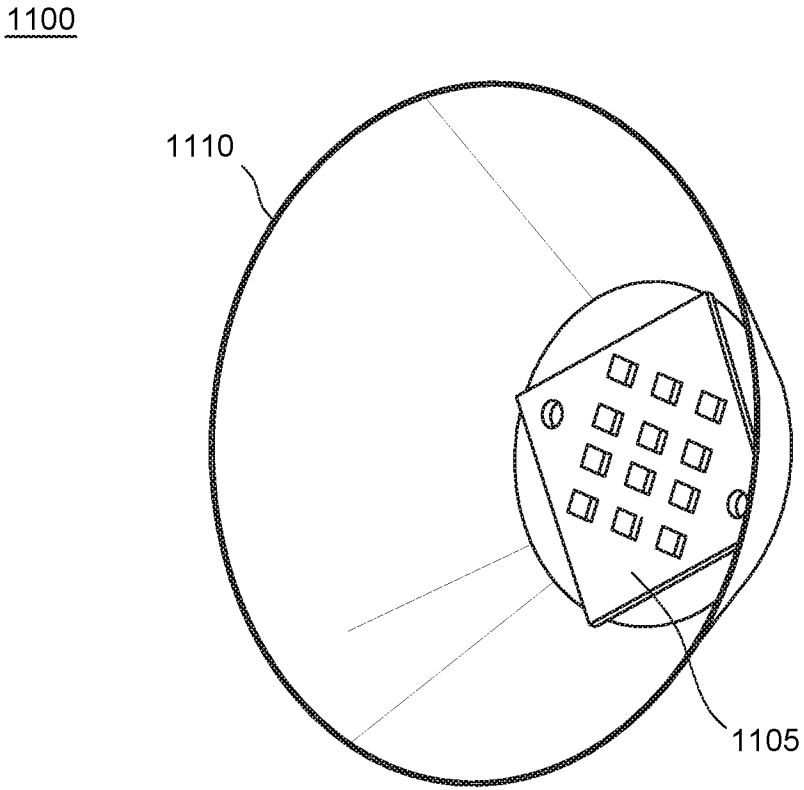
FIG. 11 is an illustrative depiction of a LED replacement module for a railway signal, according to some embodiments herein.

In some embodiments, as illustrated in FIG. 11, an illustrative depiction of a LED based replacement module or system 1100 is shown. In accordance with some aspects herein, system 1100 includes an array 1105 of white LEDs assembled on a PCB. Module 1100 further includes conical optical reflector 1110, although some other shaped reflectors may be used. In some embodiments, conical optical reflector 1110 may comprise, at least in part, a thermally conductive material. In some instances, conical optical reflector 1110 may used as a heat sink at least for white LED array 1105.

Embodiments have been described herein solely for the purpose of illustration. Persons skilled in the art will recognize from this description that embodiments are not limited to those described, but may be practiced with modifications and alterations such as those in the appended numbered claims.

What is claimed is:

1. An apparatus comprising:

a housing;

a solid state light source disposed in the housing to emit light therefrom; and a filter disposed in or on the housing in optical communication with the solid state light source to reshape a radiometric spectrum of the light emitted by the solid state light source to substantially replicate a radiometric spectrum of an incandescent filament light source;

wherein the filter has a normalized optical intensity transmission ratio of 0.35-0.45 at about 450 nm, 0.65-0.75 at about 480 nm, 0.40-0.60 between about 520 nm and about 580 nm, 0.65-0.75 at about 600 nm, and greater than 0.7 at about 640 nm.

2. The apparatus of claim 1, wherein the solid state light source comprises one LED or multiple LEDs or a Chip-On-Board (COB) LED array.

3. The apparatus of claim 1, wherein the solid state light source comprises a warm white LED.

4. The apparatus of claim 3, wherein the solid state light source comprises a warm white LED having a color temperature of about 2800 K.

5. The apparatus of claim 1, wherein the filter compensates for radiometric spectrum differences between the light emitted by the solid state light source and light emitted from an incandescent filament light source.

6. The apparatus of claim 5, wherein the filter further compensates for radiometric spectrum differences between the light emitted by the solid state light source and light emitted from an incandescent filament light source and further transmitted through a lens located in or on the housing.

7. The apparatus of claim 1, further comprising a conical or frusto-conical reflector disposed between the solid state light source and the filter to enhance optical efficiency.

8. The apparatus of claim 7, wherein the reflector comprises a curved parabolic shape.

9. The apparatus of claim 7, wherein the reflector comprises an inner surface to reflect light from the solid state light source, the inner surface having a finish including at least one of a specular finish, a frosted finish, and microfacets.

10. The apparatus of claim 7, wherein the reflector comprises, at least in part, thermally conductive materials, to provide a heat sink for the solid state light source.

11. The apparatus of claim 7, wherein the reflector has a red inner reflective surface and the filter is colored red.

12. The apparatus of claim 1, wherein the filter is characterized by the following transfer function:

$$\begin{cases} f_{White\ LEd\ Device}(\lambda) \cdot f_{Color\ Filtering}(\lambda) = f_{Incandescent}(\lambda) \\ 400\ \text{nm} \leq \lambda \leq 700\ \text{nm} \end{cases}$$

where λ is an optical intensity spectral unit in nanometers (nm) and f refers to a spectral function.

13. The apparatus of claim 1, further wherein the solid state light source comprises multiple LEDs including an array of LEDs disposed on a printed circuit board in electrical communication with the solid state light source.

14. The apparatus of claim 1, further comprising a power supply electrically coupled to the solid state light source, wherein the power supply can operatively matingly interface with an electrical connection of a railway signal without a need to modify the railway signal.

15. An apparatus comprising:

a housing;

a solid state light source disposed in the housing to emit light therefrom; and a filter disposed in or on the housing in optical communication with the solid state light source to reshape a radiometric spectrum of the light emitted by the solid state light source to substantially replicate a radiometric spectrum of an incandescent filament light source;

wherein the filter compensates for radiometric spectrum differences between the light emitted by the solid state light source and a light emitted from an incandescent filament light source, and wherein the filter further compensates for radiometric spectrum differences between the light emitted by the solid state light source and a light emitted from an incandescent filament light source and further transmitted through a colored lens located in or on the housing;

wherein the colored lens has a color selected from the group consisting of: blue, red, green, yellow, white, magenta/violet, and cyan.

16. An apparatus comprising:

a housing;

a solid state light source disposed in the housing to emit light therefrom; and a filter disposed in or on the housing in optical communication with the solid state light source to reshape a radiometric spectrum of the light emitted by the solid state light source to substantially replicate a radiometric spectrum of an incandescent filament light source;

wherein the filter has an optical transmittance spectrum defined by a low transmittance region at about 440 nm to about 460 nm, a first high transmittance region at about 470 nm to about 490 nm, a second high transmittance region at about 590 nm to about 610 nm, and a monotonic increasing transmittance for wavelengths longer than about 630 nm, wherein the filter optical transmittance spectrum is further defined by a comparatively shallow low transmittance region between about 520 nm and about 580 nm.

17. A signal housing comprising:

a solid state light source to emit warm white light therefrom;

a filter disposed in optical communication with the solid state light source, wherein the filter is configured to change a radiometric spectrum of the warm white light emitted by the solid state light source to substantially replicate a radiometric spectrum of an incandescent filament light source and the filter compensates for radiometric spectrum differences between the light emitted by the solid state light source and light emitted from an incandescent filament light source; and a signal lens disposed to receive light from the filter, the lens having a color selected from the group consisting of: blue, red, green, yellow, magenta/violet, and cyan.

18. The apparatus of claim 17, further comprising a conical or frusto-conical reflector disposed between the solid state light source and the filter.

19. The apparatus of claim 18, wherein the reflector comprises a red inner reflective surface.

* * * * *